United States Patent [19]

Daughters

[11] Patent Number: 4,490,059

[45] Date of Patent: Dec. 25, 1984

[54] RIBBON METERING DEVICE

[75] Inventor: James R. Daughters, Danville, Calif.

[73] Assignee: Wordex, San Leandro, Calif.

[21] Appl. No.: 491,507

[22] Filed: May 4, 1983

[51] Int. Cl.[3] ..... B41J 35/28

[52] U.S. Cl. ..... 400/208; 400/234; 400/235.1; 226/183

[58] Field of Search ..... 400/208, 234, 235, 235.1; 226/183, 193

[56] References Cited

U.S. PATENT DOCUMENTS

| | | | |
|---|---|---|---|
| 3,172,187 | 3/1965 | Iuanto | 226/188 |
| 3,349,887 | 10/1967 | Goff | 400/208 |
| 3,621,968 | 11/1971 | Kondur, Jr. | 400/234 |
| 3,900,099 | 8/1975 | Henglehaupt | 400/235.1 |
| 4,011,933 | 3/1977 | Kern | 400/235.1 |
| 4,053,042 | 10/1977 | Hess | 400/196 |
| 4,058,245 | 11/1977 | Hurt et al. | 226/183 |
| 4,132,486 | 1/1979 | Hess | 400/208 |
| 4,307,969 | 12/1981 | Daughters | 400/235.1 |

FOREIGN PATENT DOCUMENTS 2033340 9/1979 United Kingdom .

*Primary Examiner*—Paul T. Sewell
*Assistant Examiner*—David A. Wiecking
*Attorney, Agent, or Firm*—Townsend and Townsend

[57] ABSTRACT

A ribbon metering drive accurately advances ribbon in a ribbon cartridge. The drive includes the drive roller, driven by the printer, and an idler roller mounted adjacent the drive roller. The drive and idler rollers have roughened, typically serrated, drive surfaces. The idler roller is lightly biased against the drive roller. The ribbon is guided through the ribbon drive so that it contacts substantially more than half the roughened drive surface of the idler roller. The ribbon is pulled through the ribbon drive by the action of the idler and drive rollers at the nip and also by the frictional engagement of the ribbon contacting the roughened surface of the idler roller. The low biasing force on the idler roller reduces wear and creep in the components to provide accurate ribbon metering over a longer life than is available with prior art ribbon drives.

15 Claims, 6 Drawing Figures

RIBBON METERING DEVICE

BACKGROUND OF THE INVENTION

Printers of various types often use removable ribbon cartridges to provide a supply of inked or carbon ribbon between the printing head and the print medium. As printers have become faster and more reliable, the quality and reliability of the ribbon cartridges has become of greater importance. In some cases, especially with high speed printers coupled to automatic paper feeders capable of unassisted operation, ribbon cartridges have become the weak link in the printing system. Thus, any seemingly small improvement in ribbon cartridge design which will increase ribbon cartridge life without sacrificing reliability, consistency in operation, or low cost is a significant advancement in the field.

One method for decreasing the cost of ribbon cartridges, without decreasing quality, is by the use of reusable cartridges. Such cartridges are typically reused by sending them to a central location where they are opened, their various components cleaned and checked and then recharged with a new ribbon. The recycling of the ribbon cartridges can result in a substantial savings to the user compared with disposing of a spent ribbon cartridge. However, the success of recycling depends upon the continued reliability of the cartridges after repeated use. Economics dictates that the initial cost of a recyclable cartridge must be similar to that of a standard disposable cartridge. Therefore, higher quality, but more expensive, materials often cannot be substituted to improve the cartridges' operating characteristics.

Another factor which has made the reliable operation of ribbon cartridges more important is the increased use of inked ribbons. Inked ribbons have the ability to allow multiple overstrikes, as opposed to the single-strike capability of carbon ribbon. With multi-strike ribbon it is very important that the ribbon be advanced accurately so the character impressions are uniform.

One type of commonly used ribbon cartridge includes a ribbon supply spool, a ribbon drive assembly and a ribbon take-up spool. See, for example, U.S. Pat. No. 4,132,485 to Hess. The ribbon passes from the supply spool, out of the cartridge through a ribbon exit, back into the cartridge at a ribbon entrance spaced apart from the ribbon exit, through the ribbon drive and to the take-up spool. A constant torque is applied to the take-up spool by the printer so that it gathers the used ribbon exiting the ribbon metering drive.

This type of prior art cartridge meters the ribbon through the cartridge via the ribbon drive rather than the take-up spool. The ribbon drive typically includes a drive roller, connected to an incrementally advancing drive in the printer, and an idler roller biased against the drive roller. The rollers have serrations or teeth which securely grip the ribbon passing between them.

One problem with many of these prior art cartridges is that a relatively high biasing force must be applied between the drive and idler rollers to insure accurate, positive metering of the ribbon even at very low ribbon advance rates. These relative high forces dictate that the drive within the printer be sufficiently large to overcome them.

The high biasing forces create correspondingly high amounts of friction between and wear on the various components, including the roughened drive surfaces and the various journal type bearing areas within the case. Although the rollers are often made of durable materials, the case, because of expense, is typically made from a less expensive, but also less durable, material such as polystyrene. Wear among the components can result in decreased consistency in performance in the metering drive. This problem of deterioration of performance becomes more pronounced as the multi-strike capability of ribbons is increased. Also, if the cartridges are intended to be reused, excessive deterioration in the component parts must be eliminated before the cartridge can be considered for such repeated use.

U.S. Pat. No. 4,011,933 to Kern discloses a different type of ribbon metering drive for use in a ribbon cartridge. It uses a fixed position drive roller, positioned by an arcuate support rib, and a floating idler ring, positioned by a fixed post. The centerline distance between the post and drive rollers is fixed so as to just pinch the ribbon between them. The patent states that there appears to be a wedging action between the ring and the drive roller caused by the tension force on the tape tending to push the ring towards the drive roller. A problem with this prior art design has been an unacceptable amount of wear between the ring and post and between the drive roller and support rib. As the components wear, the effective distances between them change; this can reduce the accuracy of the ribbon metering. The wear also limits the life of the ribbon cartridge thus reducing its value as a reusable ribbon cartridge.

Thus, it is seen that prior art ribbon cartridges, because of wear in their ribbon drive assemblies, have a limited life and have a tendency to fail to perform consistently over their life.

SUMMARY OF THE INVENTION

The present invention is directed to a ribbon metering drive for accurately advancing ribbon in a ribbon cartridge. The metering drive is reliable, has a long useful life, is inexpensive and performs consistently and uniformly during use.

The drive includes a metering or drive roller, which is driven by the printer, and an idler roller mounted adjacent the drive roller. The drive and idler roller have roughened, typically serrated or toothed, drive surfaces. The idler roller is lightly biased against the drive roller. The ribbon is guided through the ribbon drive so that it contacts more than half the roughened drive surface of the idler roller.

The ribbon is therefore advanced through the ribbon drive by the action of the idler and drive rollers at the nip and also by the engagement of the ribbon around a substantial portion of the roughened surface of the idler roller. Since the ribbon drive force is not exerted on the ribbon only at the nip, the force biasing the idler roller against the drive roller can be reduced, compared with prior art ribbon drives, without degradation in metering performance. Reducing the engagement force between the idler and drive rollers at the nip thus results in substantially reduced wear, longer life and more accurate ribbon metering than is available with prior art ribbon drives.

A primary advantage of the present invention is that it provides a ribbon drive which effectively regulates and controls the movement of ribbon through the cartridge for extended periods of time. Although the metering drive of the invention can be made at relatively low cost, it has a long life during which it accurately meters ribbon through the cartridge. This accurate metering function is extremely important with multi-strike ribbons having the capability for a large number of overstrikes. It is also important when the cartridge is to be reused through a recycling program.

Other features and advantages of the present invention will appear from the following description in which the preferred embodiments have been set forth in detail in conjunction with the accompanying drawings.

DETAILED DESCRIPTION OF THE PREFERRED EMBODIMENTS

Figure 1:
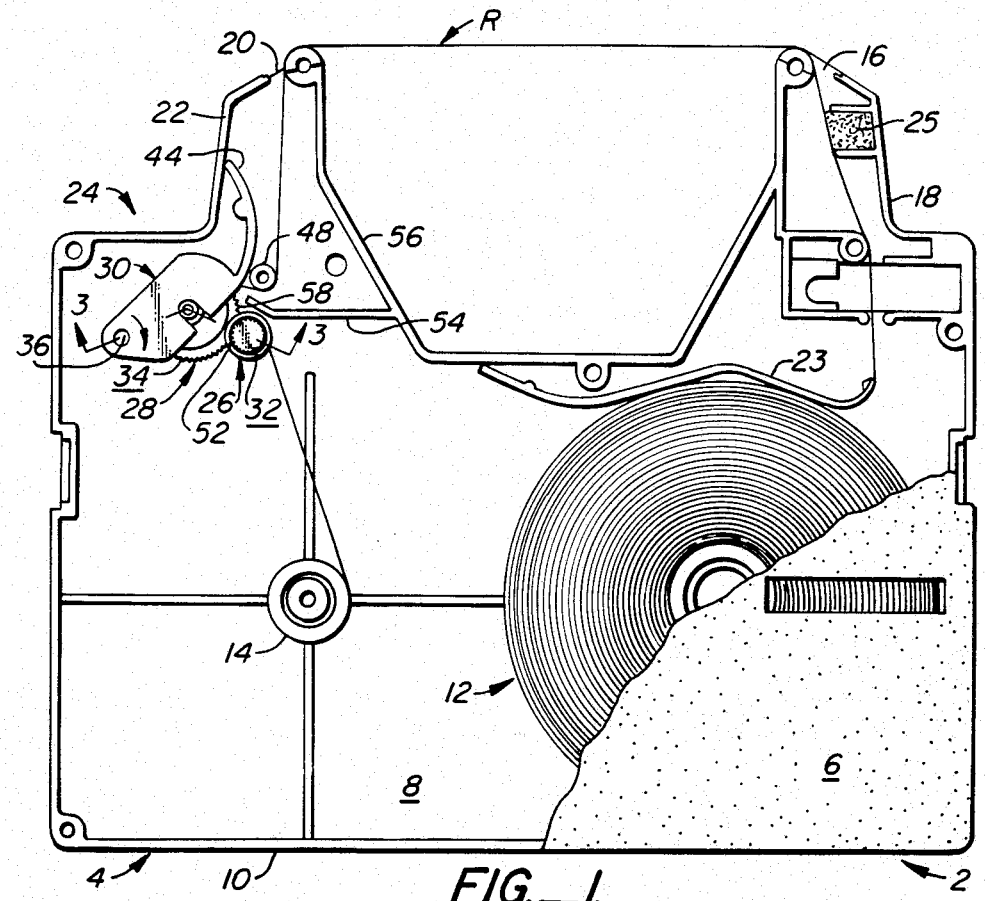
FIG. 1 is a top plan view of a ribbon cartridge incorporating the metering drive assembly of the invention with most of the upper case broken away for clarity.
Figure 3:
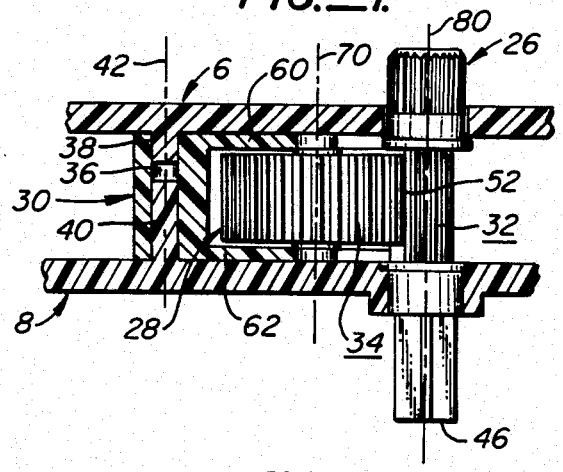
FIG. 3 is a cross-sectional view taken along line 3—3 of FIG. 1.
Figure 2:
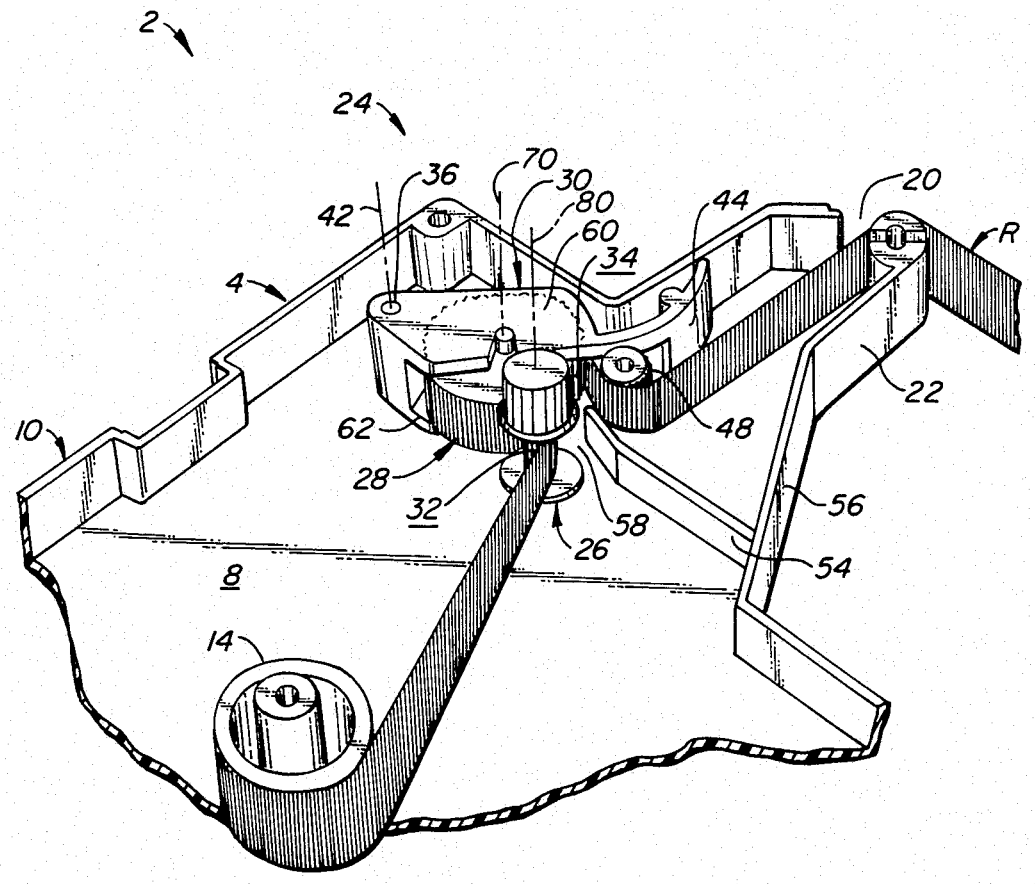
FIG. 2 is an enlarged perspective view of the metering drive assembly of FIG. 1.

Turning now to FIGS. 1, 2 and 3, a ribbon cartridge 2 is seen to include a case 4 including a top 6, a bottom 8 and sidewalls 10. A ribbon supply spool 12 and a take-up spool 14 are mounted within case 4. Ribbon R is directed from supply spool 12 to a ribbon exit 16 at the end of a first arm 18, enters the ribbon entrance 20 in a second arm 22, advances through a metering drive assembly 24, and is finally gathered by take-up spool 14. Tension is applied to ribbon R between ribbon exit 16 and ribbon entrance 20 in a conventional manner using a spring follower 23 and a spongy pad 25. Case 4, ribbon supply spool 12 and take-up spool 14 are also conventional and will therefore not be described in detail.

Metering drive assembly 24 includes a drive roller 26 rotatably mounted between top 6 and bottom 8 of case 4 and an idler roller 28 rotatably mounted within a pivotal idler roller carrier 30. Drive roller 26 has a serrated circumferential drive surface 32 which engages a similarly serrated drive surface 34 of idler roller 28. Drive roller 26 includes a lower, T-shaped spindle 46, shown in FIG. 3, for driven engagement by a printer, not shown.

Carrier 30 includes a pivot bore 36 within which complementarily shaped pins 38, 40, seen in FIG. 3 to extend downwardly from top 6 and upwardly from bottom 8, engage. This allows idler roller carrier 30 to pivot about a pivot axis 42 defined by pins 38, 40. Carrier 30 also includes a C-spring extension 44 for lightly biasing serrated surface 34 against serrated surface 32.

A guide roller 48 is rotationally mounted between top 6 and bottom 8 in a manner similar to idler roller carrier 30. Ribbon R passes through ribbon entrance 20, around guide roller 48, and engages serrated surface 34 of idler roller 28 about substantially more than half of its circumference. Ribbon R then passes between a nip 52 created at the line of contact between idler roller 28 and drive roller 26.

Idler roller carrier 30 includes a carrier top 60 and a carrier bottom 62. Top 60 and bottom 62 help to guide ribbon R and keep it substantially fully engaged with drive surface 34 of idler roller 28.

A barrier 54 is provided between an inner wall portion 56 of sidewall 10 along arm 22 and a region 58 near the exit of nip 52. Barrier 54 is provided to keep excess ribbon R, which may become unraveled from take-up spool 14 during shipment and handling, from rewrapping about idler roller 28.

In use, the printer rotates drive roller 26 through spindle 46, typically incrementally, as the characters are printed. When multi-strike ribbons are used, the amount of ribbon advanced is quite small and decreases as the overstrike capability of the particular ribbon is increased. To provide accurate and positive ribbon advancement, metering drive assembly 24 drives ribbon R in two primary ways. First, ribbon R is driven by the serrated drive surfaces 32, 34 at nip 52 in the conventional way. Second, ribbon R is also directed by metering drive assembly 24 so that it contacts substantially more than half of serrated drive surface 34 of idler roller 28. The tension on ribbon R and the large surface contact area between serrated surface 34 and ribbon R create significant frictional resistance to any slippage between ribbon R and serrated surface 34. Thus, both the frictional engagement of ribbon R with serrated drive surface 34 and the pinching engagement of ribbon R at nip 52 combine to drive ribbon R through ribbon cartridge 2. The low biasing force needed to be exerted on idler roller 28 minimizes the friction and wear among the components. With very little wear occurring, the positional relationships among the components remain substantially constant. The net result is that the operating characteristics of drive assembly 24 change much less than the prior art ribbon cartridges.

Figure 4:
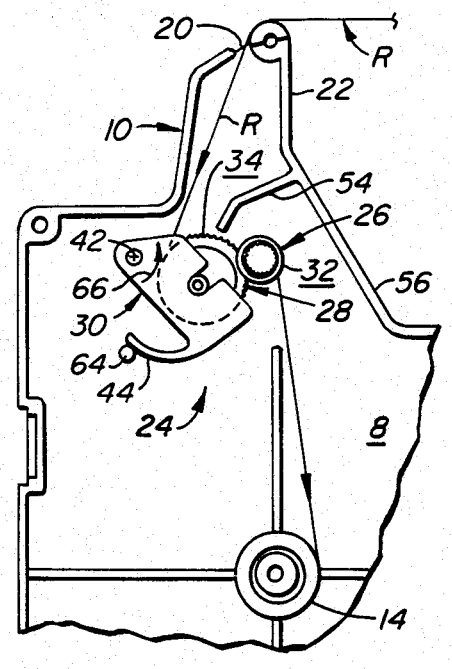
FIGS. 4 and 5 are partial plan views of alternative embodiments of the drive assembly of FIG. 1.
Figure 5:
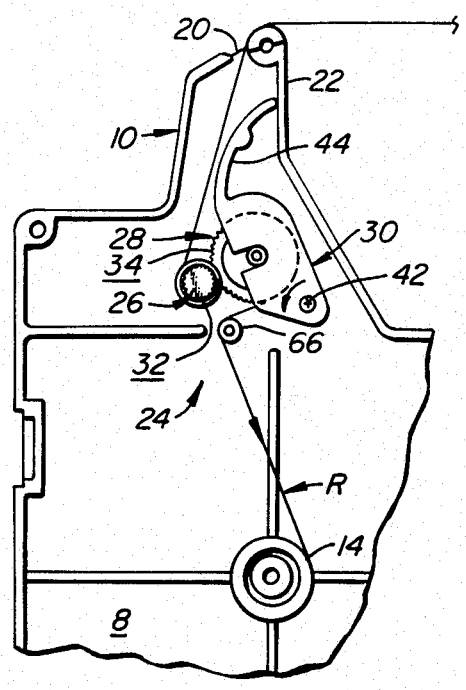

FIGS. 4 and 5 show alternative embodiments of metering drive assembly 24. Like components are indicated with like reference numerals. In the embodiment of FIG. 4, C-spring 44 exerts a force against a stationary pin 64 to bias idler roller carrier 30 in the direction of arrow 66. In this case the arrangement of carrier 30 eliminates the need for the use of a guide roller 48 since ribbon R engages substantially more than half of serrated drive surface 34 by its positioning.

FIG. 5 shows a further embodiment of the metering drive assembly 24 of the invention in which ribbon R first passes about drive roller 26 and then around idler roller 28. In this circumstance a guide roller 66 is mounted between idler roller 28 and take-up spool 14 to insure ribbon R engages substantially more than half of serrated drive surface 34 of idler roller 28. It should be noted that in this case the tension on ribbon R as it passes about idler roller 28 is from take-spool 14 rather than spring follower 23 and spongy pad 25 as in the embodiment of FIG. 1.

Figure 6:
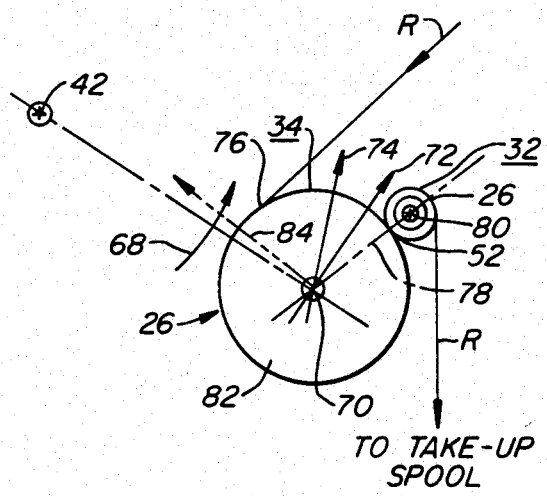
FIG. 6 is an idealized schematic representation of a drive and an idler roller illustrating the ribbon tension and spring force directions.

FIG. 6 is an idealized schematic representation of idler and drive rollers 28, 26 illustrating the directions of the idealized forces acting on metering drive assembly 24. C-spring 44, not shown in FIG. 6, tends to pivot idler roller carrier 30, also not shown in FIG. 6, and thus idler roller 28 about pivot axis 42 in the direction of an arrow 68. The idler roller carrier 30 exerts this force created by spring 44 through an idler roller axis 70 so that the spring force on idler roller 28 is in the direction of a spring force arrow 72.

The tension on ribbon R also produces what is termed a tension force on idler roller 28. This tension force tends to pull idler roller 28 in the direction of a tension force arrow 74, which in this idealized representation approximately bisects the angle between point of contact 76, at which ribbon R first contacts serrated drive surface 34 of idler roller 28, and nip 52. Thus both the tension and spring forces are exerted on drive roller 26 at nip 52. Components of the net force exerted on drive roller 26 are parallel and perpendicular to a centerline 78 connecting idler roller axis 70 and the drive roller axis 80 and are therefore normal and parallel to the serrated drive surfaces 32, 34 at nip 52. The force component perpendicular to centerline 78, and thus tangential to serrated drive surfaces 32, 34, tends to wedge idler roller 28 against drive roller 26.

The tension force arrow 74 only exists when ribbon cartridge 2 is being used. Thus, during storage of cartridge 2 the only force exerted by idler roller 28 on drive roller 26 is the relatively small force exerted by C-spring 44. Thus, deformation of the various components, due to plastic creep, can be reduced to a negligible amount. Since the biasing force exerted by C-spring 44 is very small, the biasing force exerted by C-spring 44 should not change to any significant extent during storage or use. Thus, sustained, accurate performance is enhanced.

If, for example, ribbon R were to contact idler roller 26 at a point 82, so that ribbon R contacted serrated drive surface 34 at less than half the circumference of surface 34, the tension force arrow would point in the direction of phantom arrow 84. Such a tension force would tend to pull drive roller 26, away from, rather than toward, nip 52. Reducing the area of contact between ribbon R and serrated drive surface 34 would also reduce the frictional engagement between them and thus require a greater spring force to be constantly applied to idler roller 26. Thus insuring that ribbon R is wrapped around substantially more than half of serrated drive surface 34 can enhance the performance and extend the useful life of drive assembly 24.

In summary, the present invention provides a ribbon metering drive which is reliable, has a long useful life, is inexpensive, performs consistently and uniformly during use and is suitable for use as a rechargeable ribbon cartridge. It does so primarily by reducing the reliance on the gripping action at the nip between the drive and idler rollers through the frictional engagement of the ribbon about substantially more than half the roughened surface of the idler roller.

Modifications and variations can be made to the disclosed embodiments without departing from the subject of the invention as defined in the following claims. For example, in this application reference has been made to its utility with multi-strike ribbons. The invention can be used with single strike ribbon as well. Also, in the disclosed embodiments the biasing force between drive and idler rollers 26, 28 is produced by spring 44 pivoting idler roller carrier 30 about pivot axis 42. A linear biasing means may be used if desired. In addition, since the biasing force exerted between drive and idler rollers 26, 28 is quite small, it is possible that with sufficiently accurate positioning of rollers 26, 28 they may both be mounted to fixed positions within case 4 at a separation to pinch ribbon R at nip 52 with sufficient force so no separate spring biasing is needed. One way to do this may be to mount both drive and idler rollers 26, 28 to a common carrier so the exact centerline distance between idler axis 70 and drive axis 80 is controlled by such carrier, not case 4.

I claim:

1. An improved ribbon metering drive for use with a ribbon cartridge of the type including a case having a top, a bottom and a side member defining a ribbon entrance and a ribbon exit, a supply of ribbon housed within the case and passing from the ribbon supply out the ribbon exit and into the ribbon entrance for gathering at a ribbon take up region within the case, the improvement comprising:

a drive roller having a drive axis and being mounted within the case for rotation about said drive axis;

an idler roller having an idler axis;

said drive and idler rollers having roughened drive surfaces;

means for rotatably mounting said idler roller within the case with said roughened drive surfaces adjacent one another to define a nip thereat to pinch ribbon passing therebetween at the nip;

means for defining a ribbon path through said ribbon drive including a first portion passing about substantially more than half said roughened drive surface of said idler roller as measured from the nip; and means for biasing said idler roller and said drive roller towards each other consisting of spring means and said ribbon, said spring means exerting a constant bias on said idler roller in a first direction, said ribbon providing a variable force in addition to said constant force as a result of the path of said ribbon, a tension in said ribbon resulting from the driving of said ribbon acting to urge said idler roller against said drive roller and thereby provide said variable force.

2. The improved ribbon metering drive of claim 1 wherein said first direction is at a first angle relative to a line joining the centers of said drive axis and said idler axis.

3. The improved ribbon metering drive of claim 1 wherein said roughened surfaces are serrated surfaces.

4. The improved ribbon metering drive of claim 1 wherein said idler roller mounting means includes an idler roller carrier pivotally mounted within the case for pivotal movement of said idler roller carrier and idler roller therewith about a pivot axis.

5. The improved ribbon metering drive of claim 4 wherein said idler roller carrier includes a carrier top and a carrier bottom closely spaced above and below said idler roller and being arranged and adapted to guide the ribbon into engagement with said roughened idler gear surface.

6. The improved ribbon metering drive of claim 1 wherein said idler roller mounting means includes an idler roller carrier and wherein said idler roller biasing means includes a spring extending from said idler roller carrier.

7. The improved ribbon metering drive of claim 6 wherein said idler roller mounting means includes means for pivotally mounting said roller carrier within the case.

8. The improved ribbon metering drive of claim 3 wherein said first angle is more than zero degrees.

9. The improved ribbon metering drive of claim 1 wherein said idler roller is upstream of said drive roller so that the ribbon contacts said idler roller before said drive roller after it enters the ribbon entrance of the case.

10. The improved ribbon metering drive of claim 1 wherein said spring biasing means acts through said idler axis.

11. The improved ribbon metering drive of claim 1 wherein said idler roller mounting means includes means for movably mounting said idler roller within the case.

12. The improved ribbon metering drive of claim 1 wherein said idler roller mounting means includes means for pivotably mounting said idler roller within the case.

13. An improved ribbon cartridge comprising:

a case having a top, a bottom and a side member defining a ribbon entrance and a ribbon exit;

a supply of ribbon housed within said case;

means for directing said ribbon from said ribbon supply out of the ribbon exit and into said ribbon entrance;

means for gathering ribbon at a ribbon take up region within the case;

a drive roller having a drive axis and being mounted within said case for rotation about said drive axis;

an idler roller having an idler axis;

means for movably mounting said idler roller within said case proximate said drive roller for rotation about said idler axis;

said drive and idler rollers having roughened drive surfaces which define a nip therebetween;

means for defining a ribbon path past said drive and idler rollers including a first portion passing about substantially more than half said roughened drive surface of said idler roller as measured from the nip; and means for biasing said idler roller and said drive roller towards each other consisting of spring means and said ribbon, said spring means exerting a constant bias on said idler roller in a first direction, said ribbon providing a variable force in addition to said constant force as a result of the path of said ribbon, a tension in said ribbon resulting from the driving of said ribbon acting to urge said idler roller against said drive roller and thereby provide said variable force

14. The improved ribbon cartridge of claim 13 wherein said ribbon gathering means includes a take-up spool.

15. An improved ribbon metering drive for use with a ribbon cartridge of the type including a case having a top, a bottom and a side member defining a ribbon entrance and a ribbon exit, a supply of ribbon housed within the case, means for directing the ribbon from the ribbon supply out of the ribbon exit and into the ribbon entrance, means for gathering ribbon at a ribbon take up region within the case, the improved metering drive comprising:

a drive roller having a drive axis and being mounted within said case for rotation about said drive axis;

an idler roller having an idler axis;

spring means for movably mounting said idler roller within said case proximate said drive roller for rotation about said idler axis, said idler and drive rollers defining a nip therebetween, said idler roller mounting means including an idler roller carrier pivotally mounted within the case, said idler roller carrier having a carrier top and a carrier bottom closely spaced above and below said idler rollers to guide the ribbon therebetween;

said drive and idler rollers having serrated drive surfaces;

means for defining a ribbon path through said ribbon drive including a first portion passing about substantially more than half said serrated drive surface of said idler roller as measured from the nip; and means for biasing said idler roller and said drive roller towards each other consisting of spring means and said ribbon, said spring means exerting a constant bias on said idler roller in a first direction, said ribbon providing a variable force in addition to said constant force as a result of the path of said ribbon, a tension in said ribbon resulting from the driving of said ribbon acting to urge said idler roller against said driver roller and thereby provide said variable force.

* * * * *